US005173069A

United States Patent [19]

Litos et al.

[11] Patent Number: 5,173,069

[45] Date of Patent: Dec. 22, 1992

[54] AUTOROTATIVE FLYER

[75] Inventors: Mark A. Litos, East Taunton; Petrus A. M. Spierings, Boston, both of Mass.

[73] Assignee: Mainstream Marketing, Inc., Taunton, Mass.

[21] Appl. No.: 799,679

[22] Filed: Nov. 21, 1991

Related U.S. Application Data

[63] Continuation of Ser. No. 593,249, Oct. 5, 1990, abandoned.

[51] Int. Cl.[5] ..... A63H 27/12; A63B 65/00

[52] U.S. Cl. ..... 446/36; 446/44; 273/428

[58] Field of Search ..... 446/34, 36–48; 273/426–428; 416/236 R, 236 A, 19

[56] References Cited

U.S. PATENT DOCUMENTS

| | | | |
|---|---|---|---|
| 482,852 | 9/1892 | Stevens . | |
| 510,290 | 12/1893 | Renear . | |
| 532,233 | 1/1895 | Faxon . | |
| 913,381 | 2/1909 | Hay | 273/428 X |
| 925,445 | 6/1909 | Bartlett . | |
| 1,413,316 | 4/1922 | Bradley | 446/34 |
| 1,651,273 | 11/1927 | Heller | 446/34 |
| 2,238,749 | 4/1941 | Pettier | 416/236 R X |
| 2,244,342 | 6/1941 | Mahick | 124/17 |
| 2,615,281 | 10/1952 | Main | 46/74 |
| 2,921,404 | 1/1960 | Lescher | 446/34 |
| 3,119,196 | 1/1964 | Alberico et al. | 46/74 |
| 3,353,295 | 11/1967 | Downey | 273/428 X |
| 3,630,186 | 12/1971 | Babyn | 124/23 |
| 3,665,641 | 5/1972 | Henderson | 446/45 |
| 3,947,993 | 4/1976 | Hoppe | 446/45 |
| 4,904,219 | 2/1990 | Cox | 446/36 |

FOREIGN PATENT DOCUMENTS

| | | | |
|---|---|---|---|
| 793980 | 2/1936 | France | 446/36 |
| 1161026 | 8/1958 | France | 446/36 |
| 1501685 | 2/1978 | United Kingdom | 446/34 |
| 1572692 | 7/1980 | United Kingdom | 273/428 |
| 2045096 | 10/1980 | United Kingdom | 446/36 |
| 2093710 | 9/1982 | United Kingdom | 446/34 |

OTHER PUBLICATIONS

"Samara Type Decelerators", Kline & Koenig, pp. 135–141, AIAA 8th Aerodynamic Decelerator and Balloon Technology Conference, Apr. 2–4, 1984.

"Analysis of Samara-Wing Decelerator Steady-State Characteristics", Peter Crimi, pp. 41–47, J. Aircraft, vol. 25, No. 1, Jan., 1988.

Green, Douglas S., "The Terminal Velocity and Dispersal of Spinning Samaras", Americant Journal of Botany, vol. 67, No. 8, Sep. 1980, pp. 1218–1224.

Norberg, R. Ake, "Autorotation, Self-Stability, and Structure of Single-Winged Fruits and Seeds (Samaras) with Comparative Remarks on Animal Flight", Biological Review, vol. 48, 1973, pp. 561–596.

*Primary Examiner*—Danton D. DeMille

*Attorney, Agent, or Firm*—Fish & Richardson

[57] ABSTRACT

An autorotative flyer comprises a circular root portion integral with a wing portion; the root being generally circular and providing a counterweight of from 55–85%, preferably 70–72%, of the total weight of the flyer and locating the center of gravity of the flyer behind the leading edge of the wing a distance equal to from 28–29% of the mean aerodynamic chord of the wing and at a spanwise distance from the root end of the flyer of from 10–21% of the root end to wing tip span; the wing of the flyer having curved leading and trailing edges and a curved tip with an integral spar along the leading edge and a wing area providing a wing loading of not more than about 0.5 lbs./ft$^2$; and, optionally, scallops on the trailing edge of the wing and a vane on the edge of the root section concentric with the center of gravity.

14 Claims, 1 Drawing Sheet

AUTOROTATIVE FLYER

This is a continuation of application Ser. No. 07/593,249, filed Oct. 5, 1990, now abandoned.

BACKGROUND OF THE INVENTION

This invention relates to autorotative flyers and more particular to single wing aerodynamic toys and sport devices.

Numerous single wing autorotative flyers have been disclosed in the prior art. U.S. Pat. No. 913,381 discloses a flyer comprising a spar with a weight at one end and ribs trailing the spar; a membrane comprising a single sheet or two sheets of paper or alternatively comprising a folded piece extending around the spar and over both sides of the ribs, forms the wing. U.S. Pat. No. 1,413,316 discloses a similar deviee in which the wing is secured between folded strips of metal which also served to provide a counterweight at the root end. U.S. Pat. No. 1,651,273 discloses a similar device. U.S. Pat. No. 2,615,281 discloses yet another such device including an aileron spoiler to retard spin in ascent and also including wheels for landing purposes. U.S. Pat. No. 2,921,404 discloses a flyer in which the wing is cambered and in which a stabilizing fin is provided aligned with the center of gravity of the device which is located at a distance behind the leading edge equal to 20%-35% and preferably 27%-29% of the mean aerodynamic chord. U.S. Pat. No. 3,119,196 discloses a device having a movable arm which extends as descent begins to adjust the position of the balance weight of the device. U.S. Pat. No. 3,353,295 discloses a single wing flyer in which the wing is rigid and cambered and including a hook to aid in launching. Finally, U.S. Pat. No. 4,904,219 discloses a flyer pointed at both ends and having an arcuate cut out on the root at the trailing edge of the flyer.

SUMMARY OF THE INVENTION

In one aspect, the present invention features an autorotative flyer comprising a single thin wing and a thick root portion integrally connected together at one end of the wing. The root portion provides a counterweight placing the center of gravity of the flyer toward the root portion at a distance behind the leading edge of the wing equal to from 28 to 29% of the mean aerodynamic chord of the wing. The location of the counterweight also places the center of gravity at a spanwise distance from the root end of the flyer of from 10 to 21% of the span of the flyer from the root end to the wing tip.

In another aspect of the invention, the flyer is provided with a thin vane on the edge of the root opposite the tip of the wing and opposite the center of gravity. The vane lies in the plane of the wing.

In yet another aspect of the present invention, the flyer is provided on the trailing edge of the wing with an even number of scallops on opposite sides of the wing adjacent of the root portion of the flyer.

In preferred embodiments of the invention, the area of the wing relative to the total weight of the flyer is such that the wing loading does not exceed approximately 0.5 lbs./ft.$^2$. The weight of the root portion of the flyer is from 55 to 85% and preferably from 70 to 72% of the total weight of the flyer. The vane provided at the end of the root, preferably comprises a relieved portion of the root and extends about the circumferential portion of root. The inner edges of the vane are preferably concentric with the center of gravity and the outer edges of the vane are generally square. The scallops provided in the trailing edge of the wing each comprise a portion of the side of a cone having its apex in the wing. The center line of each scallop is tangent to a circle concentric with the center of gravity and the distance from the trailing edge of the flyer to the apex of each cone is less than 50% of the chord of the wing.

In general, the present invention provides an autorotative flyer which can be launched to substantial height and which rapidly assumes a horizontal position and commences autorotation. The rapid self starting of autorotation advantageously permits indoor use. Additionally, a flyer constructed in accordance with the invention will have a low rate of descent maximizing the time of flight and permitting the flyer to respond to changes in local atmospheric conditions, e.g., wind and thermals. The flyer, according to the invention, is stable in flight.

BRIEF DESCRIPTION OF THE DRAWING FIGURES

Other objects, features, and advantages of the invention will be apparent to those skilled in the art from the following description of a preferred embodiment thereof taken together with the accompanying drawings, in which.

DETAILED DESCRIPTION OF A PREFERRED EMBODIMENT

Figure 1:
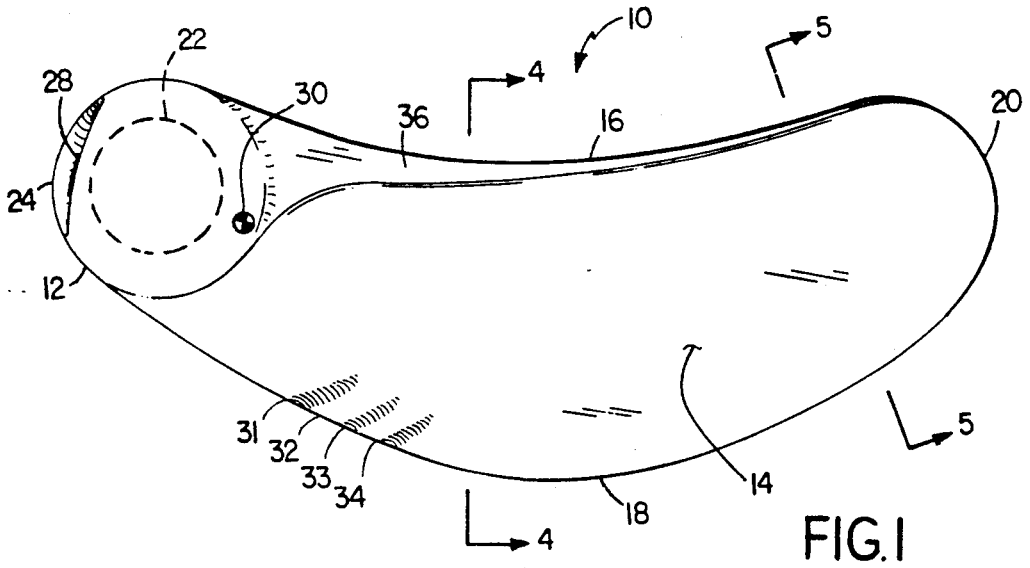
FIG. 1 is a plan view of an autorotative flyer according to the invention.

Referring now to the drawings and more particularly to FIG. 1 thereof, the autorotative flyer 10 of the invention comprises a curved, generally circular root portion 12 integrally connected to wing 14. Wing 14 has curved leading and trailing edges 16, 18 which merge into a curved wing tip 20. The flyer is preferably made of a light weight injection molded organic plastic material such as polypropylene.

Figure 2:
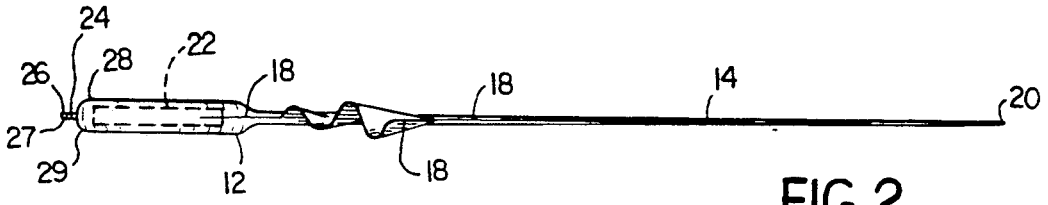
FIG. 2 is an elevation view of the trailing edge of the flyer.
Figure 3:
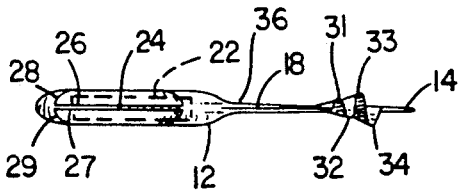
FIG. 3 is an elevation view of the root end of the flyer.

As illustrated in FIGS. 2 and 3, the root of the flyer has substantial thickness to provide a counterweight locating the center of gravity in the flyer toward the root area 12 thereof. The location of the center of gravity 30 of the flyer is important to the optimum performance. To enhance the total mass of the counterweight at the root 12 and to properly locate the center of gravity, a metal disc 22 of, e.g., steel or lead, may be encapsulated in the thick root portion 12 of the flyer so that the total weight of the root portion 12 is from 55% to 85%, preferably 70% to 72%, of the total weight of the flyer. In general, the center of gravity may be located at a distance behind the leading edge 16 of the wing equal to from 25% to 50% of the mean aerodynamic chord of the wing and at a spanwise distance from the end 24 of the root area 12 of the flyer of from 5% to 40% of the span of the flyer from the root end to the wing tip. Although, using these general parameters will result in an operable flyer, it has been found that improved performance is obtained in preferred embodiments when the center of gravity 30 and the aerodynamic center of the flyer are located on the pitch axis of the wing; this result is achieved by locating the center of gravity at a distance behind the leading edge 16 equal to from 28% to 29% of the mean aerodynamic chord of the wing and at a spanwise distance from the root end 24 of from 10 to 21% of the span from the root end to the wing tip 20. This results in a stable balance of the aerodynamic and inertial forces of flight at an 8° to 10° angle of attack. For larger flyers, e.g., having a span of at least six inches, a location of the center of gravity at the lower end of the spanwise range is preferred. The mass of the root is thus adjusted to properly locate the center of gravity in accordance with the preferred parameters.

As illustrated in FIG. 1, the root area 12 generally forms a circle, the outer edge of which extends between the leading and trailing edges 16, 18 of the flyer. The edge of the root area remote from center of gravity 30 is relieved or cut away to form a thin vane 24 lying in the plane of the wing at the root and having sharp square (in section) edges 26 and 27. As illustrated, to maximize the effect of the vane, it is located as far as possible from the center of gravity and extends along a substantial circumferential portion of the root edge. The inside edges 28, 29 at which the vane is formed extend along an arc essentially concentric with the center of gravity 30 to reduce drag at the root section. The remaining edges of the root are rounded to minimize drag.

Figure 4:
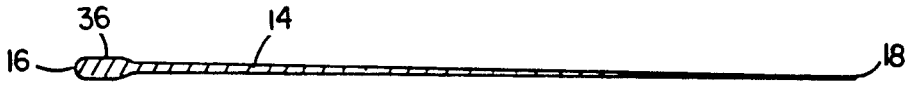
FIG. 4 is an enlarged sectional view taken along the line 4—4 of FIG. 1.
Figure 5:
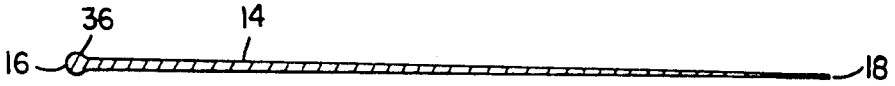
FIG. 5 is an enlarged sectional view taken along the line 5—5 of FIG. 1.

Wing 14 includes an integral spar 36 extending from the root area 12 to the wing tip 20, spar 36 also being integral with the root. The leading edge of the wing at spar 36 is rounded. Spar 36 carries the load of the wing 14 and is somewhat thicker than the wing as illustrated in FIGS. 4 and 5. The thickness and the rearward extension of the spar from the leading edge diminish moving from the root 14 to the wing tip 20. The rear edges of the spar 36 are rounded and merge into the wing 14. Wing 14 is tapered in thickness being thicker at the leading portion meeting spar 36 than at the trailing edge 18, in a preferred embodiment, being approximately 0.015 to 0.020 inches thick behind the spar and 0.006 to 0.010 inches thick at the trailing edge. The taper of the wing distributes its mass toward the leading edge aiding in properly locating the center of gravity. Additionally, the wing area of the flyer is selected to provided a wing loading, i.e., total weight of the flyer divided by wing area, of 0.5 lbs./ft.$^2$ or lower, e.g., in an actual embodiment 0.27 lbs./ft.$^2$.

In the illustrated embodiment, the trailing edge 18 of the wing relatively near the root of the flyer is provided with an even number of scallops 31, 32, 33, and 34. Each scallop merges into the next and forms a half cone extending into the wing. The center line of each cone is tangent at the trailing edge to an arc concentric with the center of gravity. The cones forming the scallops extend into the wing preferably a distance substantially less than 50% of the chord of the wing. The radius of each cone at the trailing edge of the wing is from 5% to 15%, preferably from 5% to 10% of the chord of the wing at the position of the cone at the trailing edge, the radii of scallops 33, 34 being somewhat larger than those of scallops 31, 32.

In use, the flyer is launched by hand into flight, root area first. The mass of the root area, including weight 22, allows launching to altitude, provides energy for autorotation, and balances the centrifugal and aerodynamic forces of the wing. After the flyer is launched, even before descent commences, the interaction of the root vane with the atmosphere aids in causing the flyer to assume a horizontal position and to rotate. The scallops at the trailing edge of the blade serve a similar function. The shape and size of the flyer affect weight distribution and flight characteristics. The low wing loading of 0.5 lbs./ft.$^2$ or lower and a high rotational speed, reduce the descent rate. High rotational speed is achieved by minimizing aerodynamic drag of the root area by achieving a proper wing angle of attack and by optimizing the wing cross sectional design. The rounded smooth surfaces of the root area and edges 28, 29, other than vane 24, minimize drag at the root. Mass distribution and proper location of the center of gravity control the wing angle of attack which is preferably between 8° and 10° for thin flat wing sections. The wing angle of attack can be determined experimentally by measuring the wing pitch angle and by observing the wing tip speed and the helix angle of the spiral of the flyer in flight; the angle of attack is determined by subtracting from the helix angle, the wing pitch angle and the induced angle of attack. Adjustments to the mass and wing area distributions of the flyer will alter the angle of attack. For high rotational speed, the wing cross-section is smooth, has a rounded leading edge, is tapered from the leading edge behind the spar to a thin trailing edge, the tapering also contributing to proper mass distribution, and has a curved tip. As autorotation commences during descent, the slow descent and rapid rotation maximize the time of flight and permits the flyer to soar in wind and thermal currents.

Other embodiments of this invention will occur to those skilled in the art which are within the scope of the following claims.

What is claimed is:

1. An autorotative flyer comprising a single thin wing and a thick root portion integrally formed at one end of the wing, said root providing a counterweight placing the center of gravity of said flyer toward the root portion thereof at a distance behind the leading edge of said wing equal to from 28% to 29% of the mean aerodynamic chord of said wing, characterized in that:

the center of gravity of said flyer is located at a distance from the root end of the flyer of from 10% to 21% of the span of the flyer from the end of the flyer at the root to the wing tip at the other end of the flyer, said autorotative flyer further characterized in that the total weight of the flyer divided by the area of the wing provides a wing loading of not more than about 0.5 lbs./ft.$^2$, said autorotative flyer being further characterized in that the weight of said root portion is from 55% to 85% of the total weight of the flyer, and said autorotative flyer being further characterized in that a thin vane, thinner than said thick root, is provided in the plane of the wing on the edge of the root at the end of the flyer opposite the wing tip and the center of gravity for initiating autorotation, said vane comprising an inner edge at the edge of said root, said vane extending only part of the way about the outer circumferential portion of the root, and said vane having its inner edges concentric with the center of gravity, the concentric nature of said inner edge acting to reduce drag during autorotation.

2. The autorotative flyer claimed in claim 1 further characterized in that the weight of said root portion is from 70% to 72% of the total weight of the flyer.

3. The flyer of claim 1 wherein said flyer comprises organic, non-foam plastic material.

4. The flyer of claim 3 wherein said material comprises polypropylene.

5. An autorotative flyer comprising a single thin wing and a thick root portion integrally formed at one end of the wing, said root providing a counterweight placing the center of gravity of said flyer toward the root portion thereof at a distance behind the leading edge of said wing equal to from 28% to 29% of the mean aerodynamic chord of said wing, characterized in that:

the center of gravity of said flyer is located at a distance from the root end of the flyer of from 10% to 21% of the span of the flyer from the end of the flyer at the root to the wing tip at the other end of the flyer, further characterized in that an even number of scallops are provided in the trailing edge of the wing on opposite sides thereof adjacent the root portion of the flyer.

6. The autorotative flyer claimed in claim 5 further characterized in that each scallop comprises a portion of the side of a cone having its apex in the wing and the center line of each scallop is tangent to a circle concentric with the center of gravity.

7. An autorotative flyer comprising a single thin wing and a thick root integrally formed at one end of the wing, said root providing a counterweight placing the center of gravity of said flyer toward the root end thereof, said wing having a tip at the other end of said wing, characterized in that:

a thin vane, thinner than said thick root, is provided in the plane of the wing on the edge of the root opposite the tip of the wing and the center of gravity, and said vane comprises an inner edge at the edge of said root, extends only part of the way about the outer circumferential portion of the root, and has its inner edge concentric with the center of gravity, said vane initiating autorotation, the concentric nature of said inner edge acting to reduce drag during autorotation.

8. The autorotative flyer claimed in claim 7 further characterized in that the outer edges of said vane are generally square.

9. An autorotative flyer comprising a single thin flexible wing and a thick root integrally formed at one end of the wing, said root providing a counterweight placing the center of gravity of said flyer toward the root end thereof characterized in that:

an even number of scallops are provided in the trailing edge of the wing on opposite sides thereof adjacent the root portion of the flyer.

10. The autorotative flyer claimed in claim 9 further characterized in that each scallop comprises a portion of the side of a cone having its apex in the wing and the center line of each scallop is tangent to a circle concentric with the center of gravity.

11. The autorotative flyer claimed in claim 10 further characterized in that the distance from the trailing edge of the flyer to the apex of each cone is less than 50% of the chord of the wing.

12. An autorotative flyer comprising a single thin wing and a thick root portion integrally formed at one end of the wing, said root providing a counterweight placing the center of gravity of said flyer toward the root portion thereof at a distance behind the leading edge of said wing of from 28% to 29% of the chord of said wing at the position of said center of gravity, characterized in that:

the center of gravity of said flyer is located at a distance from the root end of the flyer of from 10% to 21% of the span of the flyer from the end of the flyer at the root to the wing tip at the other end of the flyer, the total weight of the flyer divided by the area of the wing provides a wing loading of not more than about 0.5 lbs./ft.$^2$, the weight of said root portion is from 55% to 85% of the total weight of the flyer, a thin vane is provided in the plane of the wing on the edge of the root at the end of the flyer opposite the wing tip and the center of gravity, and an even number of scallops are provided in the trailing edge of the wing on opposite sides thereof adjacent the root portion of the flyer.

13. The autorotative flyer claimed in claim 12 further characterized in that said vane comprises a relieved portion of said root, extends about the outer circumferential portion of the root, has outer edges which are generally square and has its inner edges concentric with the center of gravity, and further characterized in that each scallop comprises a portion of the side of a cone having its apex in the wing and the center line of each scallop is tangent to a circle concentric with the center of gravity.

14. The autorotative flyer claimed in claim 13 further characterized in that the weight of said root portion is from 70% to 72% of the total weight of the flyer.

* * * * *